US010916870B2

(12) United States Patent
Wu et al.

(10) Patent No.: US 10,916,870 B2
(45) Date of Patent: Feb. 9, 2021

(54) ELECTRICAL CONNECTOR

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/724,403

(22) Filed: Dec. 23, 2019

(65) Prior Publication Data

US 2020/0203865 A1 Jun. 25, 2020

(30) Foreign Application Priority Data

Dec. 21, 2018 (CN) ..... 2018 1 1570119

(51) Int. Cl.
*H01R 12/70* (2011.01)
*H01R 13/506* (2006.01)
(Continued)

(52) U.S. Cl.
CPC ..... *H01R 12/7023* (2013.01); *H01R 12/75* (2013.01); *H01R 13/506* (2013.01); *H01R 13/665* (2013.01)

(58) Field of Classification Search
CPC .. H01R 12/7023; H01R 12/75; H01R 13/506; H01R 13/665; H01R 13/6271; H01R 13/6275
(Continued)

(56) References Cited

U.S. PATENT DOCUMENTS 6,821,139 B1 * 11/2004 Wu ..... H01R 13/6275 439/352
6,945,807 B1 * 9/2005 Wu ..... H01R 13/6271 439/354
(Continued)

FOREIGN PATENT DOCUMENTS

CN 106785613 5/2017
CN 304332784 10/2017
CN 208209042 12/2018

*Primary Examiner* — Hien D Vu
(74) *Attorney, Agent, or Firm* — Wei Te Chung; Ming Chieh Chang

(57) ABSTRACT

An electrical connector includes: a housing; a locking mechanism held on the housing and including a holding portion secured to the housing, a locking portion for locking with a mating connector, and an operation portion for unlocking the locking portion from the mating connector; a plug portion including a wide surface and being connected with the mating connector in a first direction; and a cable electrically connected to the plug portion and extending out of the housing; wherein the cable extends out of the housing in a second direction that is parallel to the wide surface and perpendicular to the first direction, and the operation portion extends to an edge of the housing in a third direction opposite to the first direction.

12 Claims, 10 Drawing Sheets

(51) Int. Cl.
*H01R 13/66* (2006.01)
*H01R 12/75* (2011.01)

(58) Field of Classification Search
USPC ..... 439/358
See application file for complete search history.

(56) References Cited

U.S. PATENT DOCUMENTS

| | | | | |
|---|---|---|---|---|
| 7,182,622 | B2 * | 2/2007 | Chang | H01R 13/6275 439/352 |
| 7,785,130 | B2 * | 8/2010 | Chen | H01R 13/6271 439/354 |
| 8,870,586 | B2 * | 10/2014 | Wang | H01R 13/6335 439/358 |
| 2019/0173232 | A1 | 6/2019 | Lu et al. | |

* cited by examiner

ELECTRICAL CONNECTOR

BACKGROUND OF THE INVENTION

1. Field of the Invention

The present invention relates generally to an electrical connector, and more particularly to an electrical connector can be mated with a mating connector.

2. Description of Related Arts

China Patent No. CN304332784S discloses an electrical connector comprising a housing and a locking mechanism held on the housing. The locking mechanism includes a holding portion for holding the locking mechanism on the housing, a locking portion capable of being locked with a mating connector, a operation portion for a user to unlock the electrical connector from the mating connector. When multiple electrical connectors are installed side by side, a sufficient large space is required between every two adjacent electrical connectors in order for a user to access the operation portion to unlock the electrical connector from the mating connector, which takes a larger space.

An improved electrical connector is desired.

SUMMARY OF THE INVENTION

A main object of the present invention is to provide an electrical connector with a locking mechanism that cooperates with a mating connector and minimizes space for multiple side by side electrical connectors while making it easier to unlock the electrical connector from the mating connector.

To achieve the above-mentioned object, an electrical connector comprises: a housing; a locking mechanism held on the housing and including a holding portion secured to the housing, a locking portion for locking with a mating connector, and an operation portion for unlocking the locking portion from the mating connector; a plug portion including a wide surface and being connected with the mating connector in a first direction; and a cable electrically connected to the plug portion and extending out of the housing; wherein the cable extends out of the housing in a second direction that is parallel to the wide surface and perpendicular to the first direction, and the operation portion extends to an edge of the housing in a third direction opposite to the first direction.

Compared to the prior art, the plug portion of the electrical connector is mated to the mating connector in a first direction, the cable extends out of the housing in a second direction perpendicular to the first direction, and the operation portion extends to the edge of the housing in a third direction opposite to the first direction. Multiple electrical connectors are installed side by side for easy unlocking of the electrical connector from the mating connector.

DETAILED DESCRIPTION OF THE PREFERRED EMBODIMENT

Figure 1:
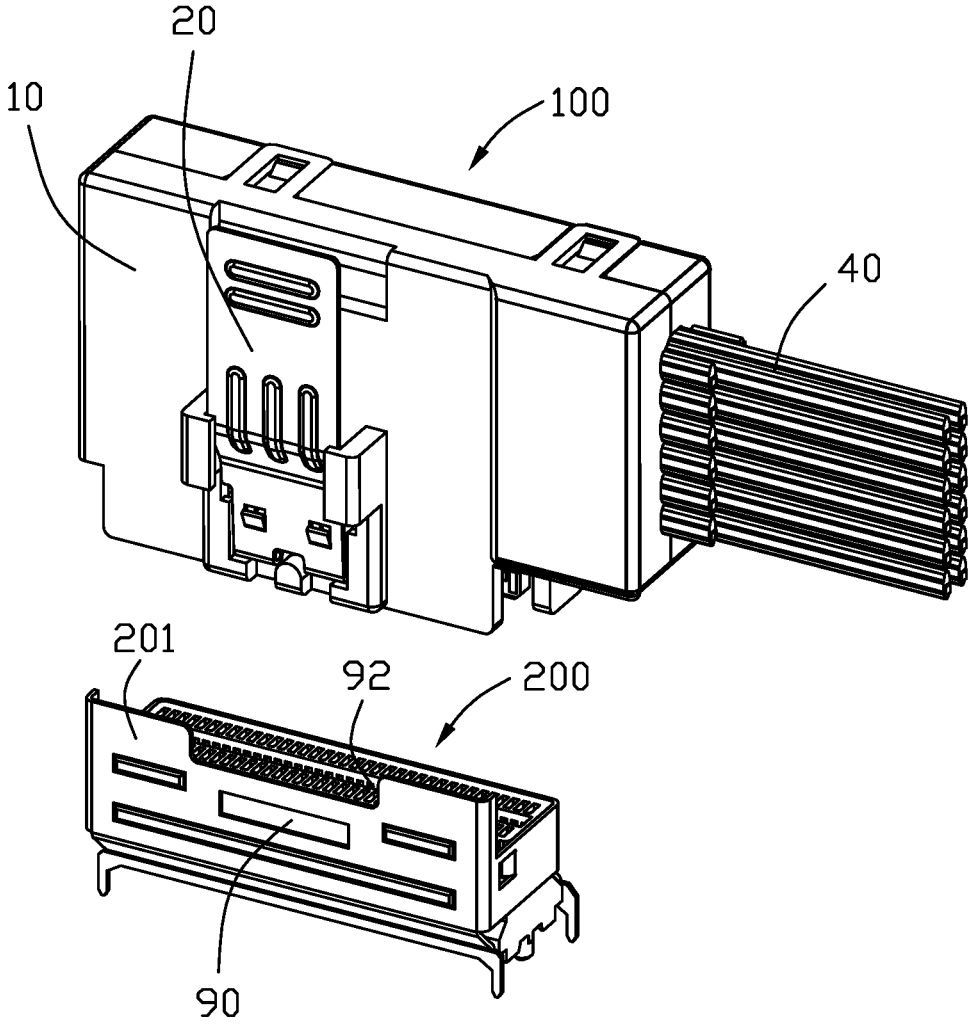
FIG. 1 is a perspective view of an electrical connector in accordance with the present invention before mating with a mating connector.
Figure 2:
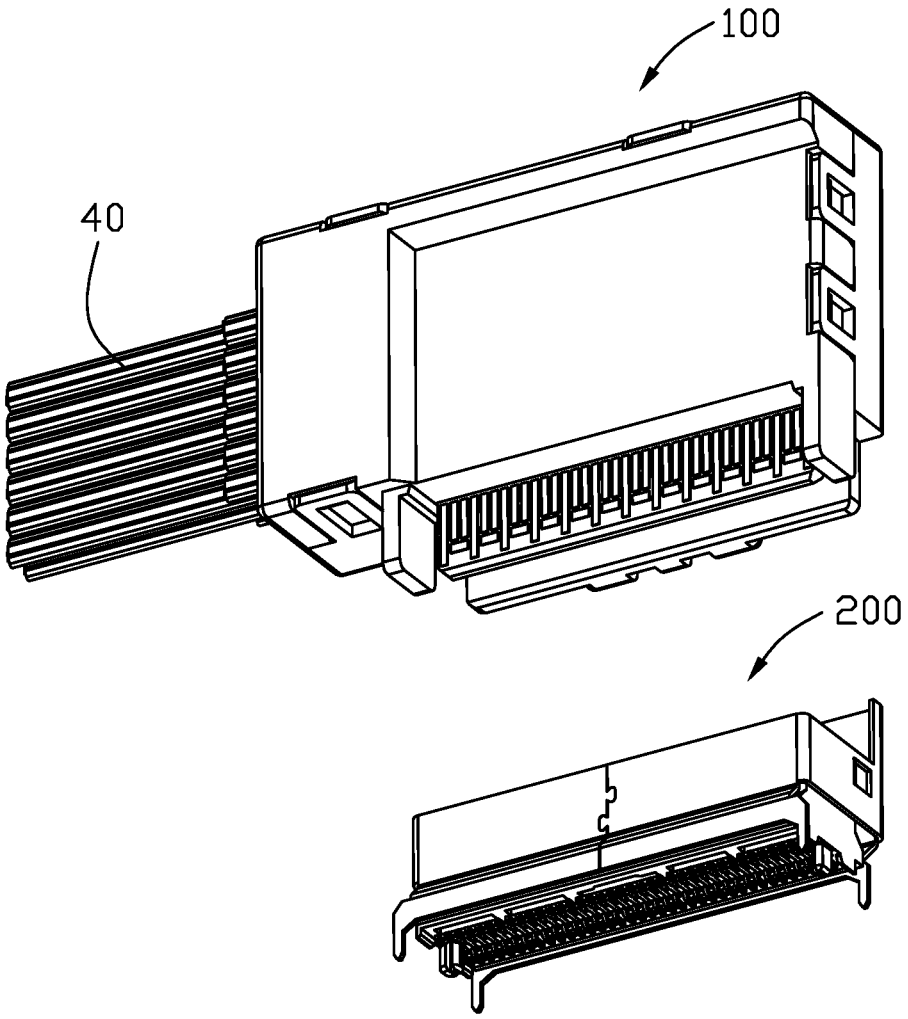
FIG. 2 is an another perspective view of the electrical connector accordance with the present invention before mating with the mating connector as shown in FIG. 1.
Figure 3:
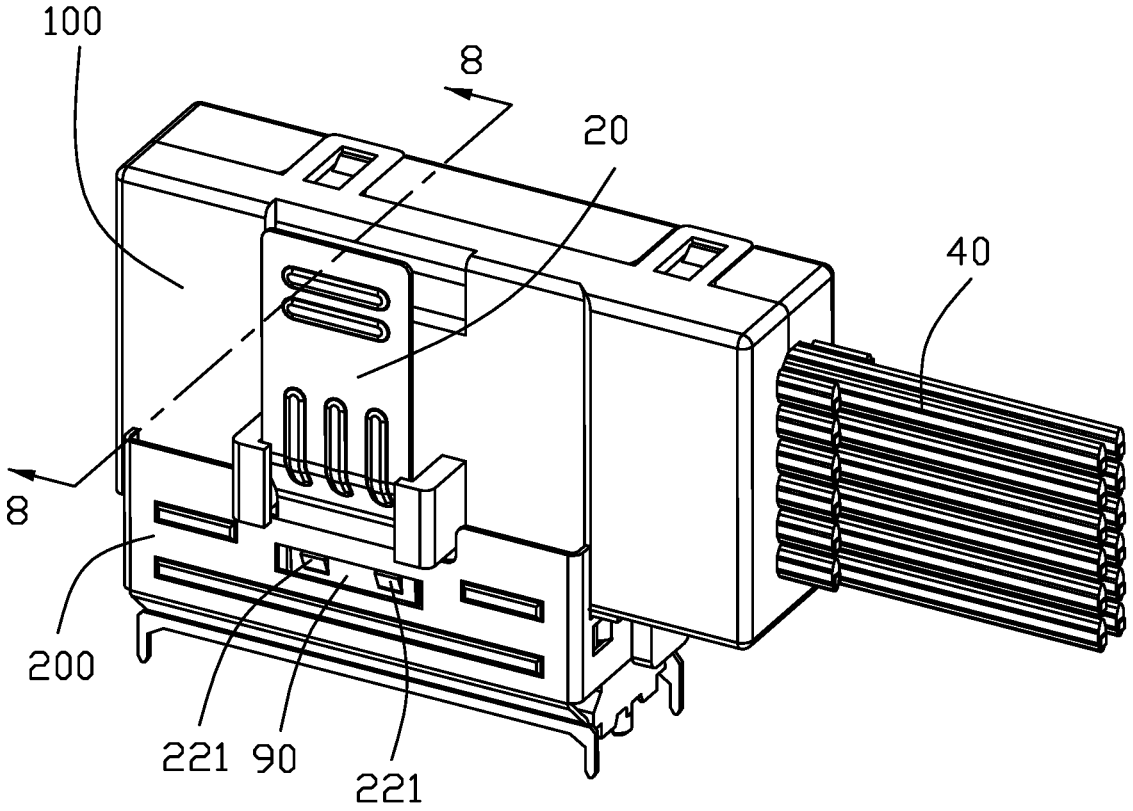
FIG. 3 is a view of an electrical connector in accordance with the present invention after mating with the mating connector as shown in FIG. 1.
Figure 4:
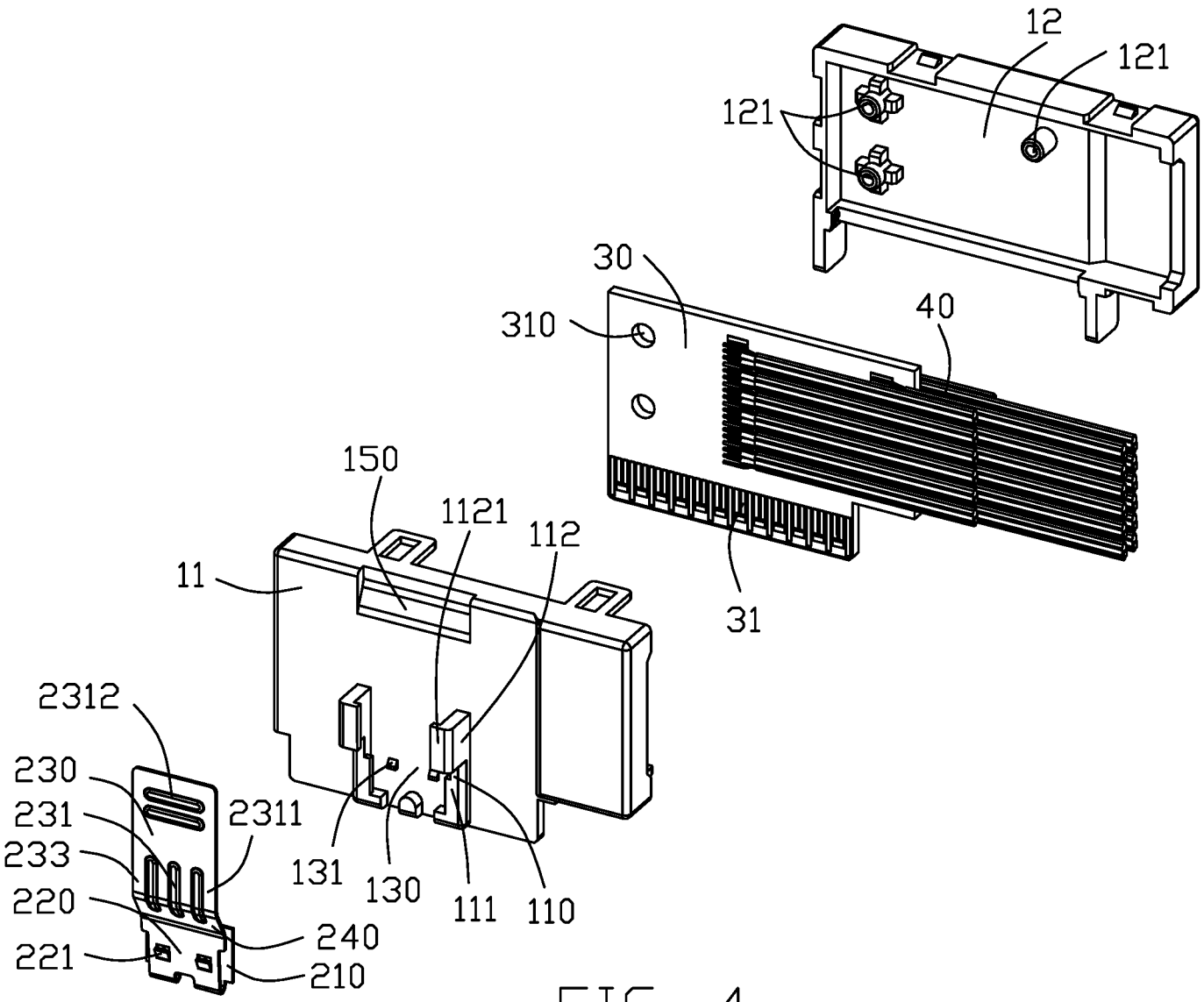
FIG. 4 is an exploded view of the electrical connector as shown in FIG. 1.
Figure 5:
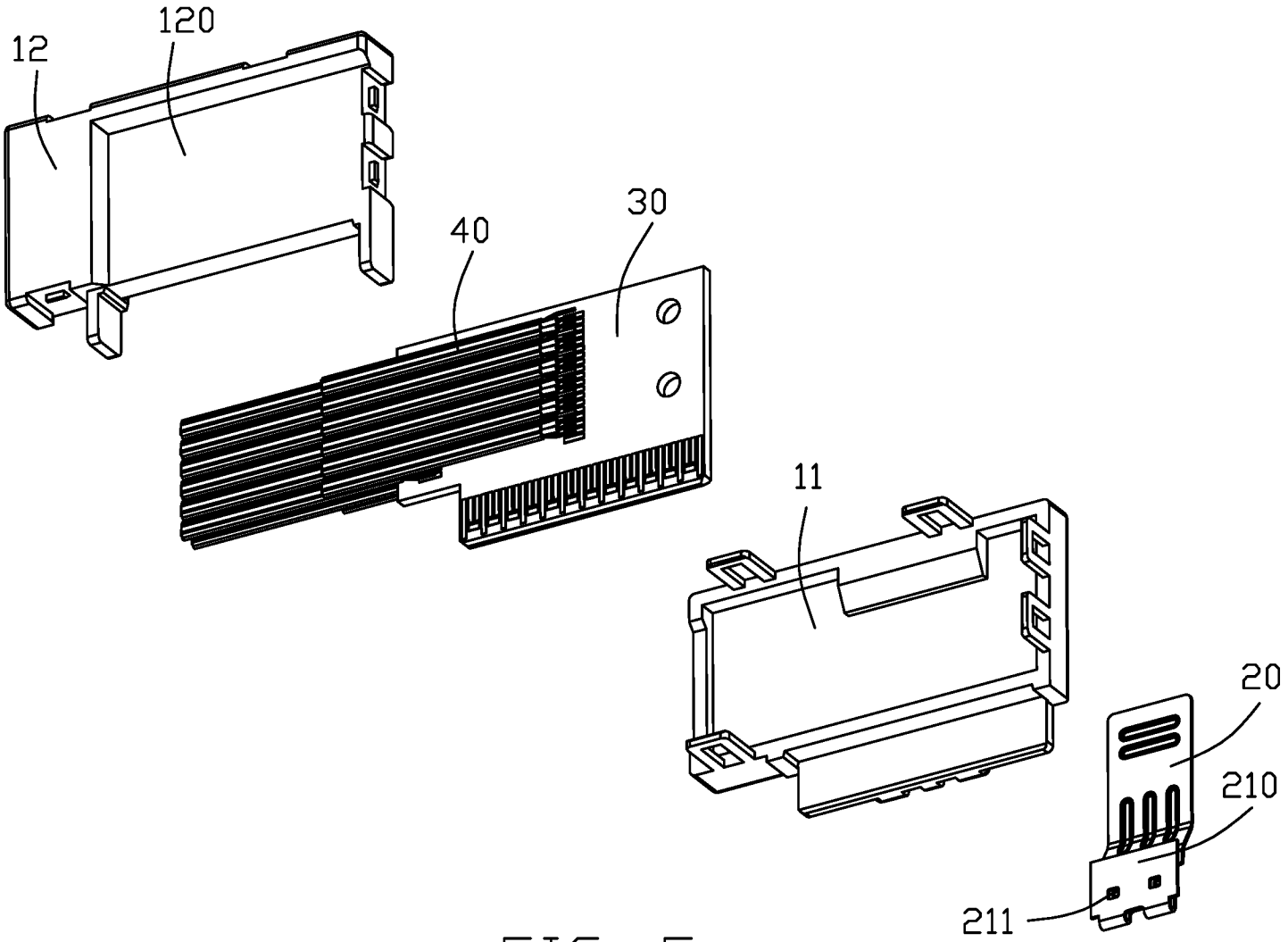
FIG. 5 is another exploded view of the electrical connector as shown in FIG. 4.
Figure 6:
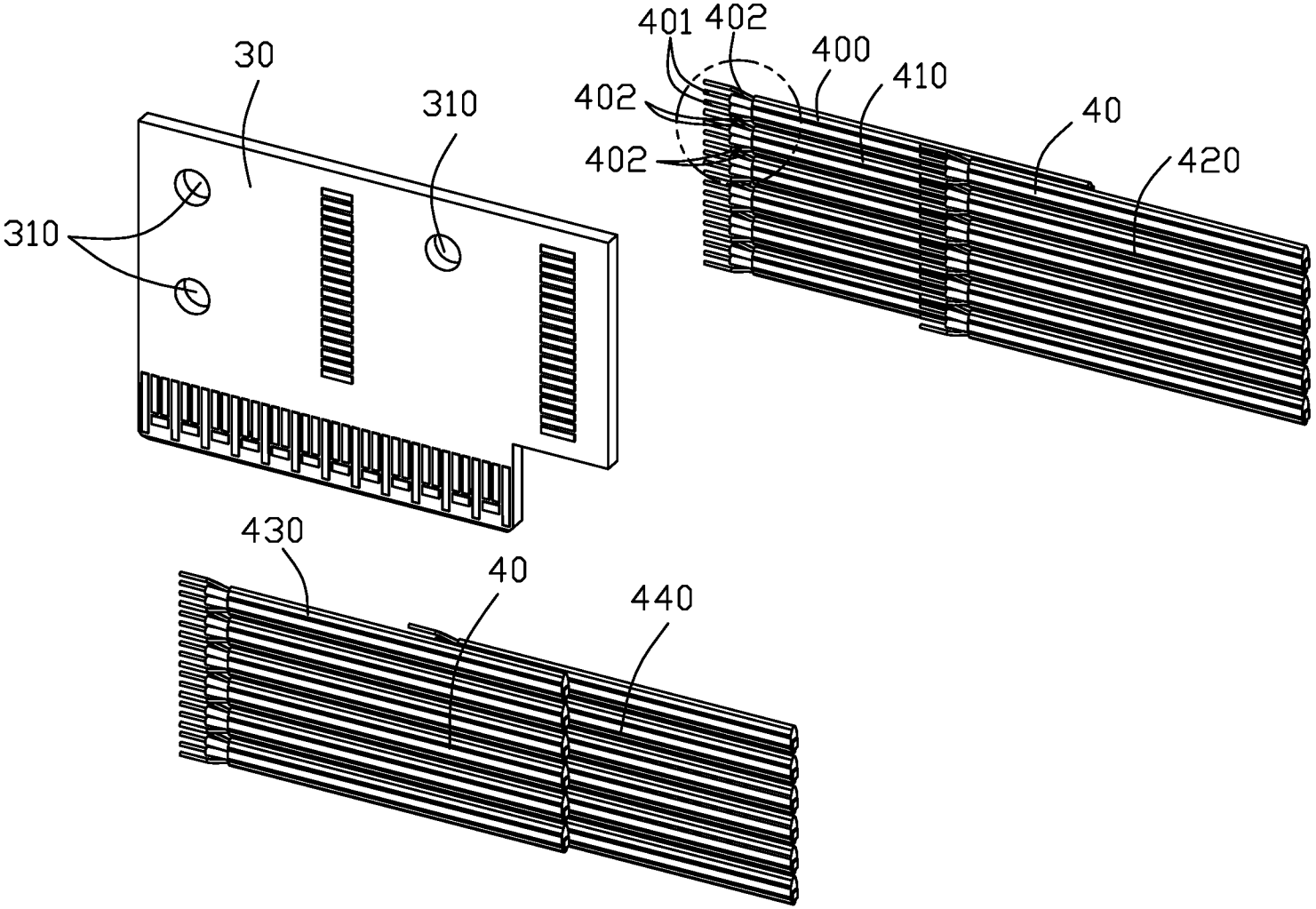
FIG. 6 is a partial exploded view of electrical connector as shown in FIG. 4.
Figure 7:
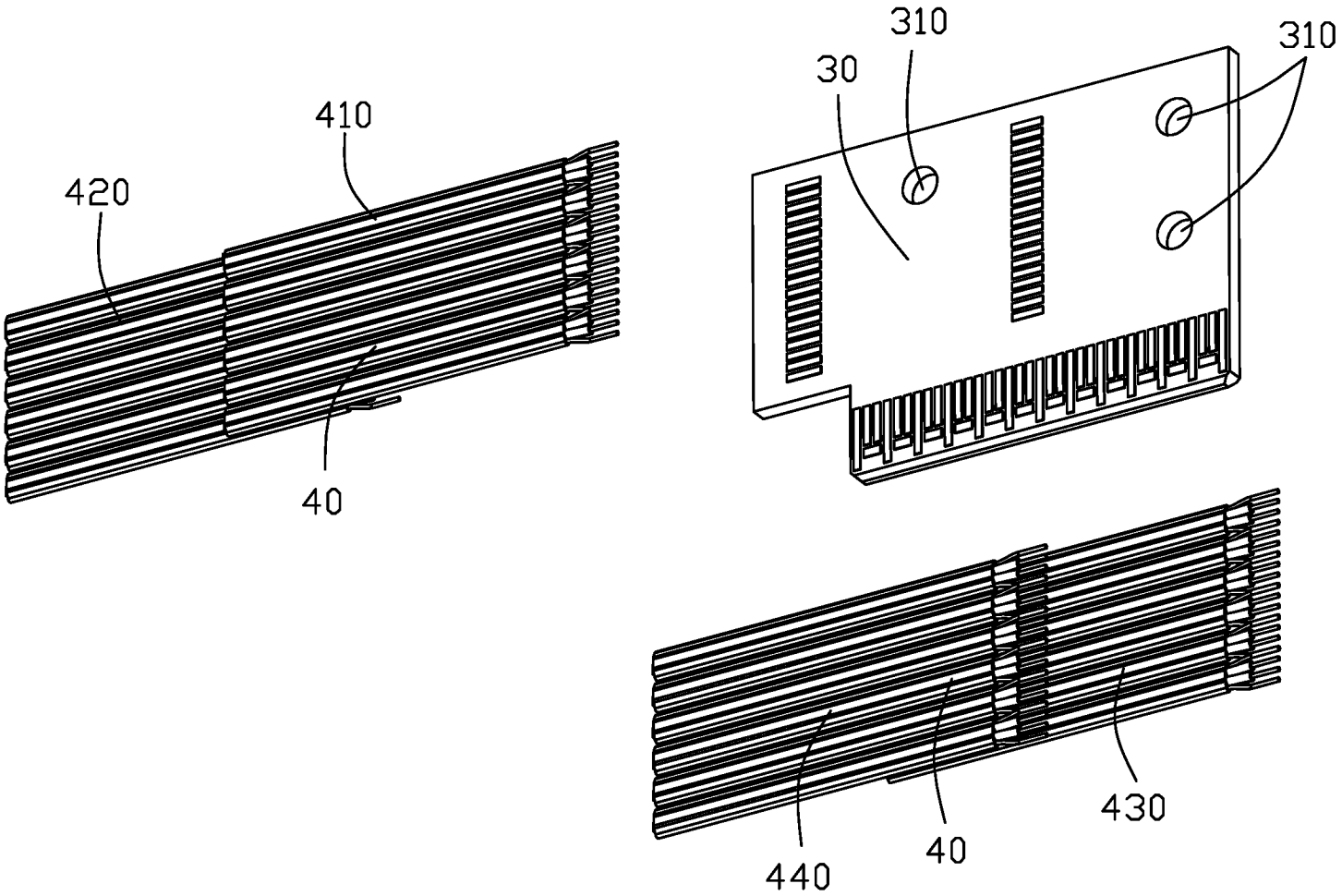
FIG. 7 is another partial exploded perspective view of the electrical connector as shown in FIG. 6.

Referring to FIG. 1-10, an electrical connector 100 of the present invention is configured to mate with a mating connector 200, the plug electrical connector 100 comprising a housing 10 and a locking mechanism 20 held on the housing 10, a plug portion or the mating edge 31 of the internal printed circuit board 30 for combined with the mating receptacle connector 200. And a cable 40 electrically connected to the plug portion 31 and extending out of the housing 10. The locking mechanism 20 can be locked with the outer shell 201 of the mating connector 200. The locking mechanism 20 can be directly mounted on the housing 10, or fixed to the housing 10 by other means.

The housing 10 includes an upper housing 11 and a lower housing 12 mating with the upper housing 11, The upper housing 11 is provided with two spaced-apart bosses 110 and a mounting groove 130 located between the two spaced-apart bosses 110. Two mounting protrusions 131 are provided in the mounting groove 130. Each of the two spaced-apart bosses 110 includes a first boss 111 near the front end of the upper housing 11 and a second boss 112 located at the rear end of the first boss 111 and higher than the first boss 111. The two second bosses 112 extend oppositely from the top to form a limiting boss 1121. A recess 150 is provided on an end of the upper housing 11 opposite to the two spaced-apart bosses 110. The recess 150 includes a first recess 151 that extends obliquely downward from the upper surface of the upper housing 11 and a second recess 152 extending horizontally and rearwardly through the rear end surface of the upper housing 11 along the rear end of the first recess 151. A groove 120 is provided on the outer surface of the lower housing 12, it is convenient for users to grip the housing 10 with their fingers when inserting and removing the electrical connector 100 with the mating connector 200.

The locking mechanism 20 is made of metal material. The locking mechanism 20 includes a holding portion 210 that holds the locking mechanism 20 in the housing 10. a locking portion 220 capable of being locked with the mating connector 200, and an operation portion 230 for a user to operate to unlock the electrical connector 100 from the mating connector 200. The locking mechanism 20 extends backward and upward from the front end of the holding portion 210 to the front end of the locking portion 220, continue from the rear end of the locking portion 220 to the operating portion 230. The holding portion 210 includes a pair of mounting holes 211 that can be installed in the housing 10. When the locking mechanism 20 is mounted to the housing 10. The holding portion 210 is mounted and received in the mounting groove 130, The mounting protrusion 131 is installed in the mounting hole 211. The upper surface of the operation portion 230 is limited to the lower surface of the limiting boss 1121 to prevent the operation portion 230 from moving away from the housing 10. The locking portion 220 includes a pair of outwardly protruding buckles 221. When the electrical connector 100 is mated with the mating connector 200, the buckles 221 protrude into the openings 90 in the outer shell 201 of the mating connector 200 so that the electrical connector 100 is locked with the mating connector 200. The operation part 230 is provided with ribs 231. The ribs 231 include a first rib 2311 located on the operation portion 230 near the locking portion 220 to strengthen the locking mechanism 20 and a second rib 2312 located on the operating portion 230 away from the locking portion 220. The second rib 2312 not only increases the strength of the locking mechanism 20 but also increases the friction between the finger and the operating portion 230, when the user unlocks the electrical connector 100 from the mating connector 200; even blind-mating is feasible when the installation space is limited, i.e., a user need not see with his or her eyes but only use finger to feel the operation portion 230 to unlock the electrical connector 100. When the electrical connector 100 needs to be unlocked from the mating connector 200, the user applies a force on the second rib 2312 in a direction toward the housing 10 so that the operation portion 230 moves toward the housing 10 and the rear section of the operation portion 230 can be moved to the recess 150, and the buckles 221 on the locking portion 220 moves downward to escape from the openings 90 on the outer shell 201 of the mating connector 200, thereby unlocking the electrical connector 100 from the mating connector 200. The first recess 151 extending obliquely and downwardly along the surface of the housing 10 has the same inclination as the direction in which the operation portion 230 moves toward the housing 10 so that the first recess 151 can well accommodate the operation portion 230 that is tilted toward the housing. The inclined first recess 151 and the horizontal second recess 152 increases the movement and deformation space of the operation portion 230 toward the housing 10 while ensuring the necessary structural space of the electrical connector 100.

The electrical connector 100 further includes a circuit board 30 housed in the housing 10. The circuit board 30 has a plurality of positioning holes 310 that cooperate with the positioning posts 121 on the lower housing 12. The cable 40 is electrically connected to the circuit board 30. The cable 40 includes a first row of cables 410, a second row of cables 420, a third row of cables 430 and a fourth row of cables 440. The first and third rows of cables 410 and 430 are symmetrically soldered to the upper and lower sides of the circuit board 30, respectively. The second and fourth rows of cables 420 and 440 are symmetrically soldered to the upper and lower sides of the circuit board 30, respectively. Each rows of cables include a plurality of wires 400. Each wire 400 includes a pair of differential signal wires 401 and a pair of ground wires 402 on opposite sides of the differential signal wires 401. The adjacent ground wires 402 of the adjacent wires 400 are in contact with each other and soldered to the same position on the circuit board 30, which is beneficial to the symmetry of high-frequency signal transmission. The front portion of the circuit board 30 forms the plug portion 31. The electrical connector 100 is connected to the mating connector 200 through the plug portion 31. The electrical connector 100 is connected to the mating connector 200 in a first direction. The cable 40 extends out of the housing 10 in a second direction perpendicular to the first direction. The operation portion 230 extends to the edge of the housing 10 in a third direction opposite to a first direction. The direction in which the cable 40 extends out of the housing 10 and the direction in which the operation portion 230 extends are not in the same direction, in this way, the user will not be blocked by the cable 40 when using the operation portion 230 to unlock the electrical connector 100 from the mating connector 200, at the same time, the operation portion 230 extends to the edge of the housing 10, and further the operation portion 230 extends beyond the edge of the housing 10, when multiple electrical connectors 100 are installed side by side, a user unlocks the electrical connectors, the fingers can be unlocked the electrical connector 100 without extending too much into the gap between two adjacent electrical connectors 100. This can reduce the installation space between two adjacent electrical connectors 100, further more can reduce the installation space, which in turn reduces the size of the entire device.

Figure 8:
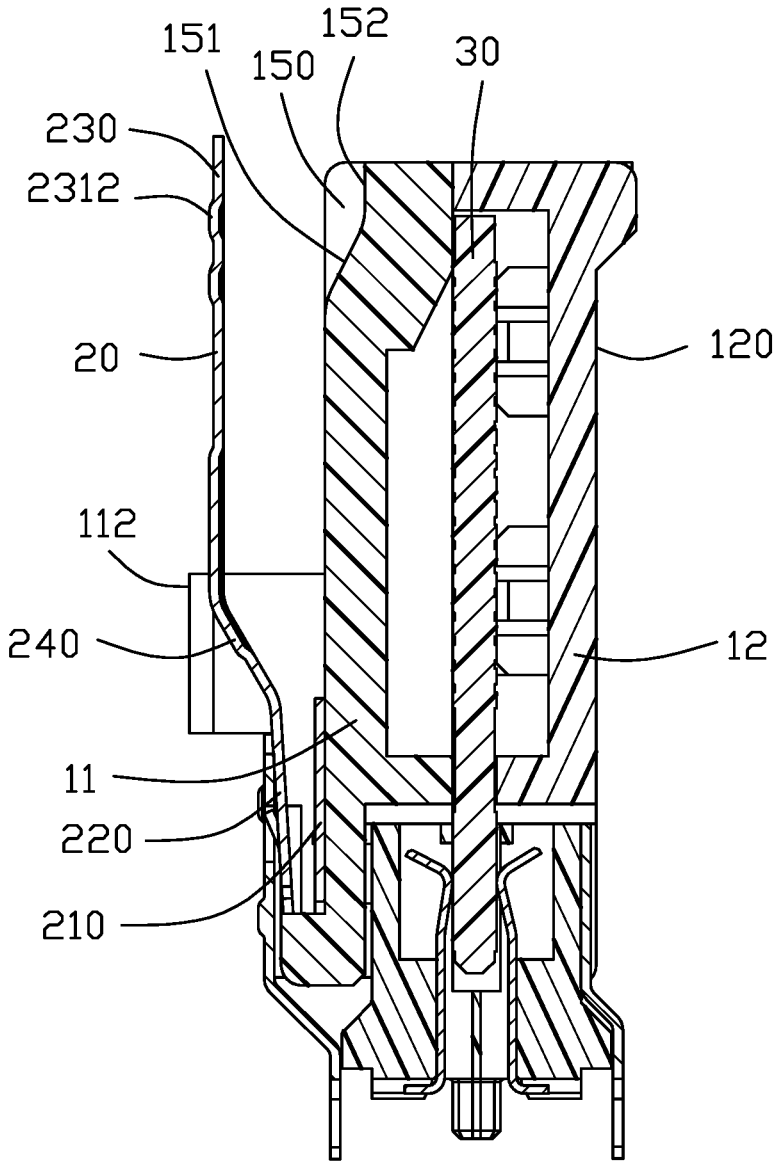
FIG. 8 is a cross-sectional view along line 8-8 of the electrical connector is in a locked state with the mating connector as shown in FIG. 3.
Figure 9:
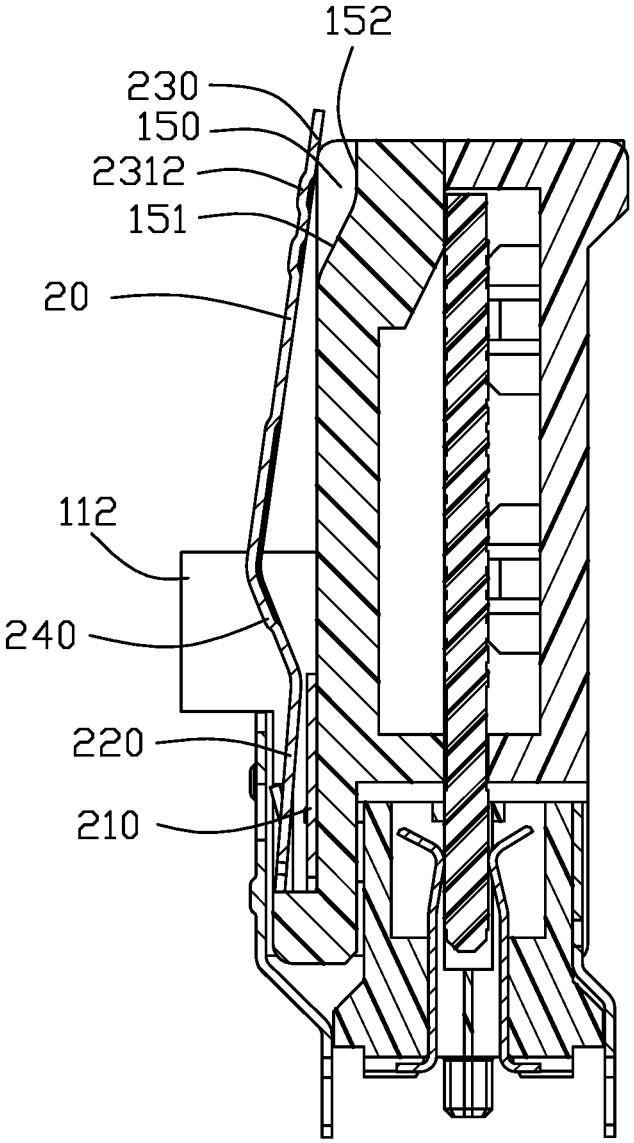
FIG. 9 is a cross-sectional view along line 8-8 of the electrical connector is in an unlocked state with the mating connector as shown in FIG. 3.
Figure 10:
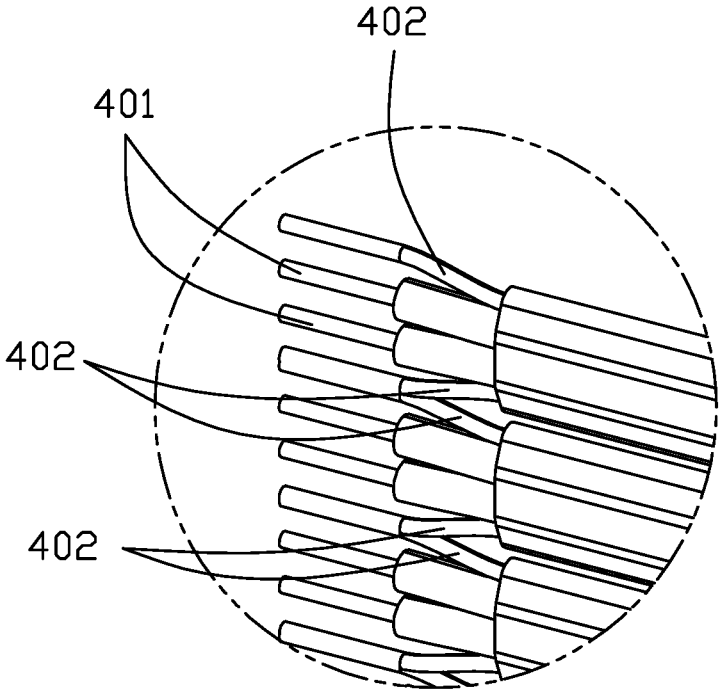
FIG. 10 is a partial enlarged view of electrical connector as shown in FIG. 1.

When assembling the electrical connector 100, the cable 40 is soldered to the circuit board 30 first, then the circuit board 30 and the lower housing 12 are assembled with each other, then the upper housing 11 and the lower housing 12 are assembled with each other, and finally, the locking mechanism 20 is installed in the mounting groove 130 of the upper housing 11. In this embodiment, the outer shell 201 further forms a recess 92 in an upper edge to receive lower portions of the second bosses 112 while still exposing the upper portions thereof. The opening 90 extends along the longitudinal direction along which the cable 40 extends. In this embodiment, the dimension of the housing 10 along the vertical direction is essentially three fifths of that along the longitudinal direction for compliance with the sideward extension of the cable 40, compared with those with the vertical extension or rearward extension of the cable that have the increased dimension in the vertical direction. In brief, in the invention the plug connector 100 and the receptacle connector 200 are mated with each other in the vertical direction Z, the cable 40 and the mating edge 31 of the printed circuit board 30 extend along the longitudinal direction Y, and the locking portion 220 and the operation portion 230 are deflected in the transverse direction Y. The invention may provide the reliable robust structure for operation. As shown in FIG. 8, an offset section 240 formed between the operation portion 230 and the locking portion 220 is protectively located between the pair of second bosses 112.

What is claimed is:

1. An electrical connector comprising:

a housing;

a locking mechanism held on the housing, the locking mechanism including:

a holding portion secured to the housing;

a locking portion for locking with a metallic outer shell of a mating connector; and an operation portion for unlocking the locking portion from the mating connector;

a plug portion including a wide surface and being connected with the mating connector in a first direction; and a cable electrically connected to the plug portion and extending out of the housing; wherein the cable extends out of the housing in a second direction that is parallel to the wide surface and perpendicular to the first direction, and the operation portion extends to an edge of the housing in a third direction opposite to the first direction;

wherein the housing has a recessed portion to increase the space for the operation portion to deform toward the housing;

wherein the housing includes an upper casing and a lower housing matched with the upper housing;

wherein the electrical connector further including a circuit board housed in the housing, and wherein the plug portion is formed on the circuit board, and the circuit board has a plurality of positioning holes assembled with a plurality of positioning posts of the housing; and wherein the cable includes a plurality of core wires, each core wire having a pair of differential signal wires and a pair of ground wires on both sides of the differential signal wires, and adjacent ground wires of adjacent core wires are connected together.

2. The electrical connector as claimed in claim 1, wherein the locking portion extends backward and upward from the front end of the holding portion, and then continues from the locking portion to the operation portion.

3. The electrical connector as claimed in claim 1, wherein the operation portion comprises a rib.

4. The electrical connector as claimed in claim 1, wherein the housing has two spaced-apart bosses and a mounting groove located between the two bosses, and the holding portion of the locking mechanism is received and held in the mounting groove.

5. The electrical connector as claimed in claim 1, wherein the recessed portion includes a first portion inclined from the upper surface of the housing and a second portion extending horizontally rearwardly and penetrating the rear end surface of the housing.

6. The electrical connector as claimed in claim 1, wherein a groove is provided on a side of the housing opposite to the side where the locking mechanism is located, for gripping the housing when removing the electrical connector from the mating connector.

7. An electrical connector assembly comprising:

a plug connector including a plug portion:

an insulative housing defining a longitudinal direction, a vertical direction and a transverse direction perpendicular to one another;

a locking mechanism retained to an exterior face of the housing and including:

a holding portion secured to the housing;

a locking portion linked to the holding portion, and an operation portion linked to the locking portion, and both the locking portion and the operation portion commonly deflectable in the transverse direction;

a pair of bosses formed upon the exterior face and spaced from each other along the longitudinal direction to be respectively located by two sides of both the locking portion and the operation portion so as to confine the operation portion in both the longitudinal direction and the transverse direction;

a receptacle connector adapted to be mated with the plug connector and including: a metallic outer shell defining a locking opening to be engaged with the locking portion, and a recess above the locking opening; wherein the recess receives lower portions of the pair of bosses therein while exposing upper portions of the bosses;

wherein a cable is connected to the plug connector and extends along the longitudinal direction;

wherein the housing includes two parts assembled to each other in the transverse direction;

wherein the electrical connector further including a circuit board housed in the housing, and wherein the plug portion is formed on the circuit board, and the circuit board has a plurality of positioning holes assembled with a plurality of positioning posts of the housing; and wherein the cable includes a plurality of core wires, each core wire having a pair of differential signal wires and a pair of ground wires on both sides of the differential signal wires, and adjacent ground wires of adjacent core wires are connected together.

8. The electrical connector assembly as claimed in claim 7, wherein the an offset section is formed between the locking portion and the operation portion, and protectively located between the pair of bosses.

9. The electrical connector assembly as claimed in claim 7, wherein a free end of the operation is received within a recess formed in an upper edge region of the exterior face.

10. The electrical connector assembly as claimed in claim 9, wherein a dimension of the housing along the vertical direction is around three fifths of that along the longitudinal direction.

11. The electrical connector as claimed in claim 9, wherein along the vertical direction, a dimension of the locking portion is around one half of that of the operation portion.

12. The electrical connector as claimed in claim 9, wherein an upper end of the operation portion is located above a top edge of the housing in the vertical direction.

* * * * *